US010420414B1

(12) United States Patent
Snyder et al.

(10) Patent No.: US 10,420,414 B1
(45) Date of Patent: Sep. 24, 2019

(54) SELF-RIGHTING CONTAINER CADDY

(71) Applicants: Robert L. Snyder, Williamston, MI (US); Randy Newman, Hesperia, CA (US); Larry Lambert, Twin Peaks, CA (US); William J. Davis, Phelan, CA (US)

(72) Inventors: Robert L. Snyder, Williamston, MI (US); Randy Newman, Hesperia, CA (US); Larry Lambert, Twin Peaks, CA (US); William J. Davis, Phelan, CA (US)

( * ) Notice: Subject to any disclaimer, the term of this patent is extended or adjusted under 35 U.S.C. 154(b) by 0 days.

(21) Appl. No.: 15/864,705

(22) Filed: Jan. 8, 2018

Related U.S. Application Data

(63) Continuation-in-part of application No. 14/982,714, filed on Dec. 29, 2015, now abandoned.

(51) Int. Cl.
*A45F 3/14* (2006.01)
*A45F 5/00* (2006.01)
*A45F 3/00* (2006.01)

(52) U.S. Cl.
CPC ..... *A45F 3/14* (2013.01); *A45F 5/00* (2013.01); *A45F 2003/007* (2013.01); *A45F 2200/0575* (2013.01)

(58) Field of Classification Search
CPC ..... Y10S 224/904; B44D 3/14; A45F 2200/0566; A45F 2003/144; A45F 2003/007; A45F 2003/002; A45F 2003/146; A45F 3/14; A45F 3/005; A45F 3/02; A45F 5/021; A45F 2200/0575
USPC ..... 224/904, 148.1, 148.5–148.7, 148.4, 224/677–679, 660, 270, 625–626
See application file for complete search history.

(56) References Cited

U.S. PATENT DOCUMENTS

| | | | | | |
|---|---|---|---|---|---|
| 3,876,125 | A * | 4/1975 | Emmert | A45F 5/00 | 224/148.7 |
| 4,527,720 | A * | 7/1985 | Hayes | A45F 5/021 | 224/148.4 |
| 4,826,059 | A * | 5/1989 | Bosch | A45C 11/24 | 206/350 |
| 4,972,982 | A * | 11/1990 | Harbour | A45F 5/00 | 224/148.4 |
| 5,826,762 | A * | 10/1998 | Dellinger | A45F 5/02 | 224/270 |
| 2012/0024927 | A1* | 2/2012 | LaFontaine | A45F 5/021 | 224/682 |
| 2014/0353352 | A1* | 12/2014 | Shapiro | A45F 5/021 | 224/663 |

* cited by examiner

*Primary Examiner* — Scott T McNurlen
(74) *Attorney, Agent, or Firm* — Cramer Patent & Design, PLLC; Aaron R. Cramer

(57) ABSTRACT

A belt and neck holder for a container such as a can of paint which offsets the container from the wearer via a double axis gimbal mechanism to provide free axial rotation of the secured container to prevent spillage. The holder is detachable from the belt and neck and provided in different sizes to hold standard containers such as a gallon can of paint.

9 Claims, 3 Drawing Sheets

SELF-RIGHTING CONTAINER CADDY

RELATED APPLICATIONS

The present invention is a continuation-in-part of, was first described in, and claims the benefit of U.S. Utility application Ser. No. 14/982,714, filed Dec. 29, 2015, the entire disclosures of which are incorporated herein by reference.

FIELD OF THE INVENTION

The present invention relates generally to a holder having a double-axis gimbal mechanism for retaining a container therein.

BACKGROUND OF THE INVENTION

When painting, it is common for a painter to have to utilize a ladder or other similar device to reach the area intended for painting. However, when a painter is forced to use a ladder, it often becomes a repetitive hassle to stop painting and climb down the ladder to refresh the brush or roller with paint. For this is not only time consuming, but potentially hard on the user's knees and back. Furthermore, going up and down repeatedly on a ladder increases the risk of an accident or injury to the user. As a result, there is a need for a means to enable a user to carry paint on a holder that is easily accessible and obviates the need for repetitive up and down ladder trips.

Such a device or holder is most efficiently worn by the user. However, paint is most typically contained within a gallon-sized paint container and anything else may prove to be too heavy for a user to easily maneuver. Therefore, there is a need to have the device be worn by the user, such as about the waist, in such a manner that the weight of the paint is evenly distributed about the body of the user while keeping the user's hands free.

Such a device must also enable the paint container to be easily accessed by the user. When worn on the waist, there are certain circumstances where quick and unbalanced movement of the user may cause the container to tip too much in one (1) direction thereby spilling the paint. It is therefore a benefit of the present invention to provide all the aforementioned desired features and be able to self-right the paint container such that it will not tip over and spill.

SUMMARY OF THE INVENTION

The inventor has recognized the aforementioned lack in the art and observed that there is a need for a holder having a double-axis gimbal mechanism for retaining a container therein.

It is therefore an object of the invention to provide a self-righting caddy, comprising a frame support assembly having a first support frame with a first proximal end fastened to a first side of a middle support frame and a first distal end rotatingly affixed to an outer ring and a second support frame with a second proximal end fastened to a second side of the middle support frame and a second distal end rotatingly affixed to the outer ring opposite the first support frame, a hip panel secured about the middle support frame, an inner ring rotatingly affixed to the outer ring and adapted to hold a container, a first strap ring secured on an interior side of the middle support frame adjacent the first side thereof, a second strap ring secured on the interior side of the middle support frame adjacent the second side thereof and a neck strap having a first neck strap end removably secured to the first strap ring by a first neck strap fastener and a second neck strap end removably secured to the second strap ring by a second neck strap fastener. The caddy is adapted to be worn by a user and the outer ring and the inner ring form a double-axis gimbaled holder for the container.

In a separate embodiment, the hip panel may comprise a plurality of waist strap apertures, a frame support assembly having a first support frame with a first proximal end fastened to a first side of the hip panel and a first distal end rotatingly affixed to an outer ring and a second support frame having a second proximal end fastened to a second side of the hip panel and a second distal end rotatingly affixed to the outer ring opposite the first support frame, an inner ring rotatingly affixed to the outer ring and adapted to hold a container, a first strap ring secured on an exterior side of the first support frame, a second strap ring secured on an exterior side of the second support frame, a neck strap having a first neck strap end removably secured to the first strap ring by a first neck strap fastener and a second neck strap end removably secured to the second strap ring by a second neck strap fastener and a waist strap routed through the plurality of strap apertures, the waist strap having a male latching clasp at a first end and a female latching class at a second end, the waist strap further including a length adjustment feature. The alternate embodiment may also comprise a slot and aperture for a second and third tool.

The hip panel may conform to the hip and waist areas of the user. The caddy may also comprise a tool holder which may further comprise a magnet. The magnet is secured to an exterior face of the first support frame. The neck strap may be length adjustable and may be made of synthetic or natural fibers. The first neck strap fastener and the second neck strap fastener may each comprise a spring hook.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
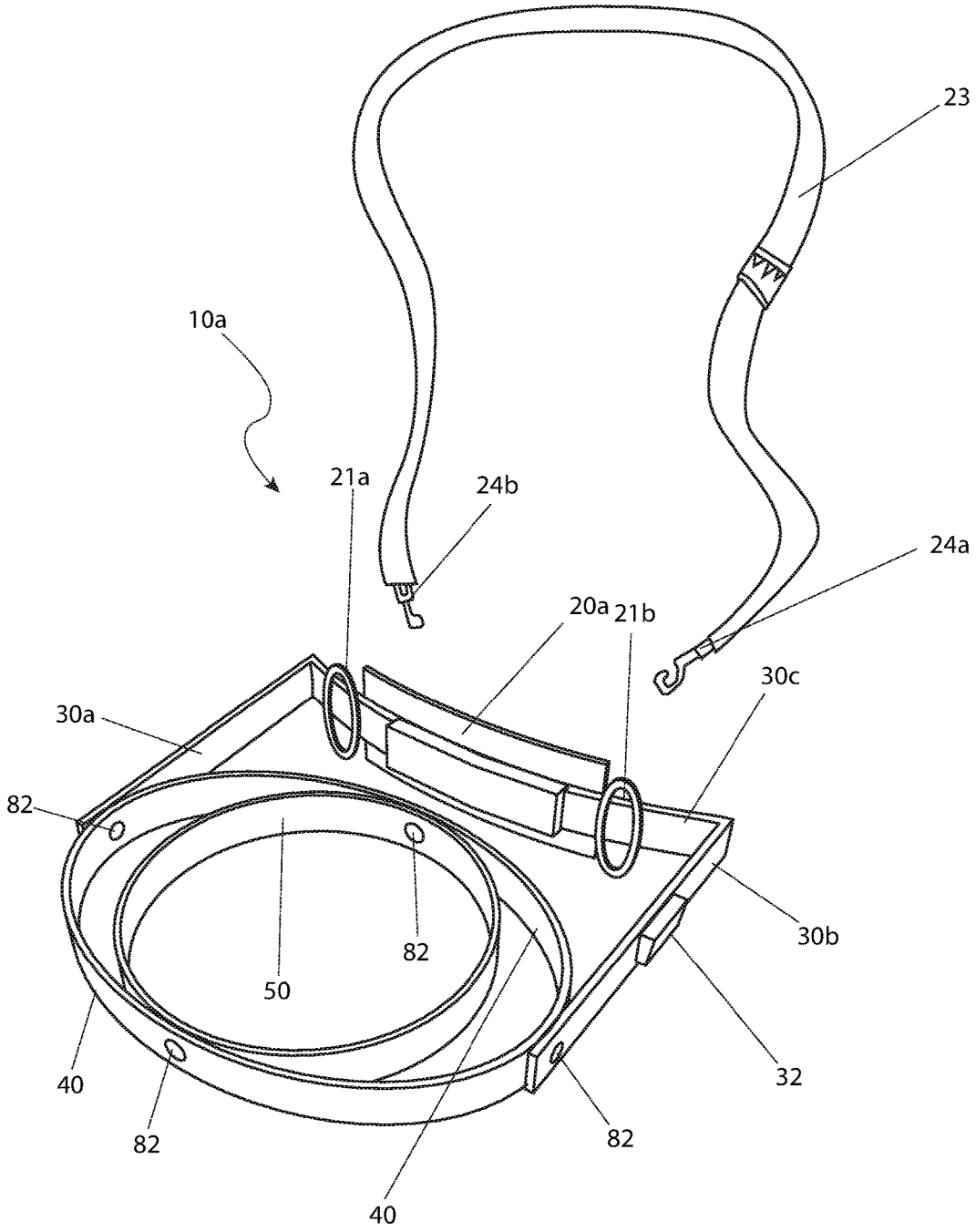
FIG. 1 is a front perspective view of a self-righting container caddy 10*a*, according to a first embodiment of the present invention.

10*a* first self-righting container caddy
10*b* alternate self-righting container caddy
20*a* first hip panel
20*b* alternate hip panel
21*a* first ring
21*b* second ring
22 strap aperture
23 adjustable neck strap
24*a* first spring hook
24*b* second spring hook
30*a* first side support bracket
30*b* second side support bracket
30*c* middle side support bracket
32 magnetic tool holder

40 outer ring
50 inner ring
60 waist strap
62 male latch portion
64 length adjustment section
66 female latch portion
70 hip panel tool holder
72 tool slot
74 tool aperture
80 first fastener
82 second fastener
84 third fastener
100 first tool
105 second tool
110 container
115 paint brush
200 user

DETAILED DESCRIPTION OF THE PREFERRED EMBODIMENT

Figure 2:
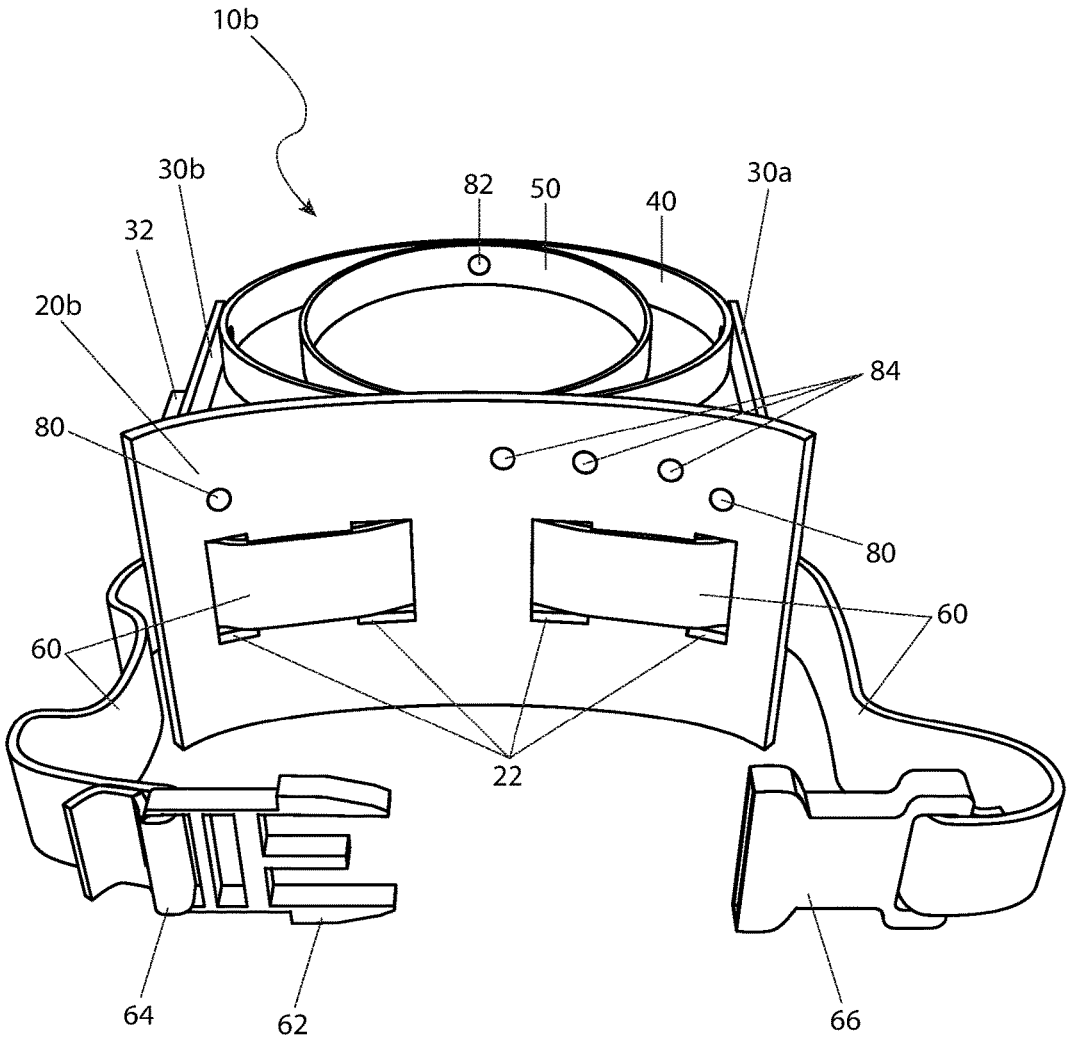
FIG. 2 is a rear perspective view of the caddy 10*b*, according to an alternate embodiment of the present invention; and, FIG. 3 is an environment view of the caddy 10*b*, according to an alternate embodiment of the present invention.
Figure 3:
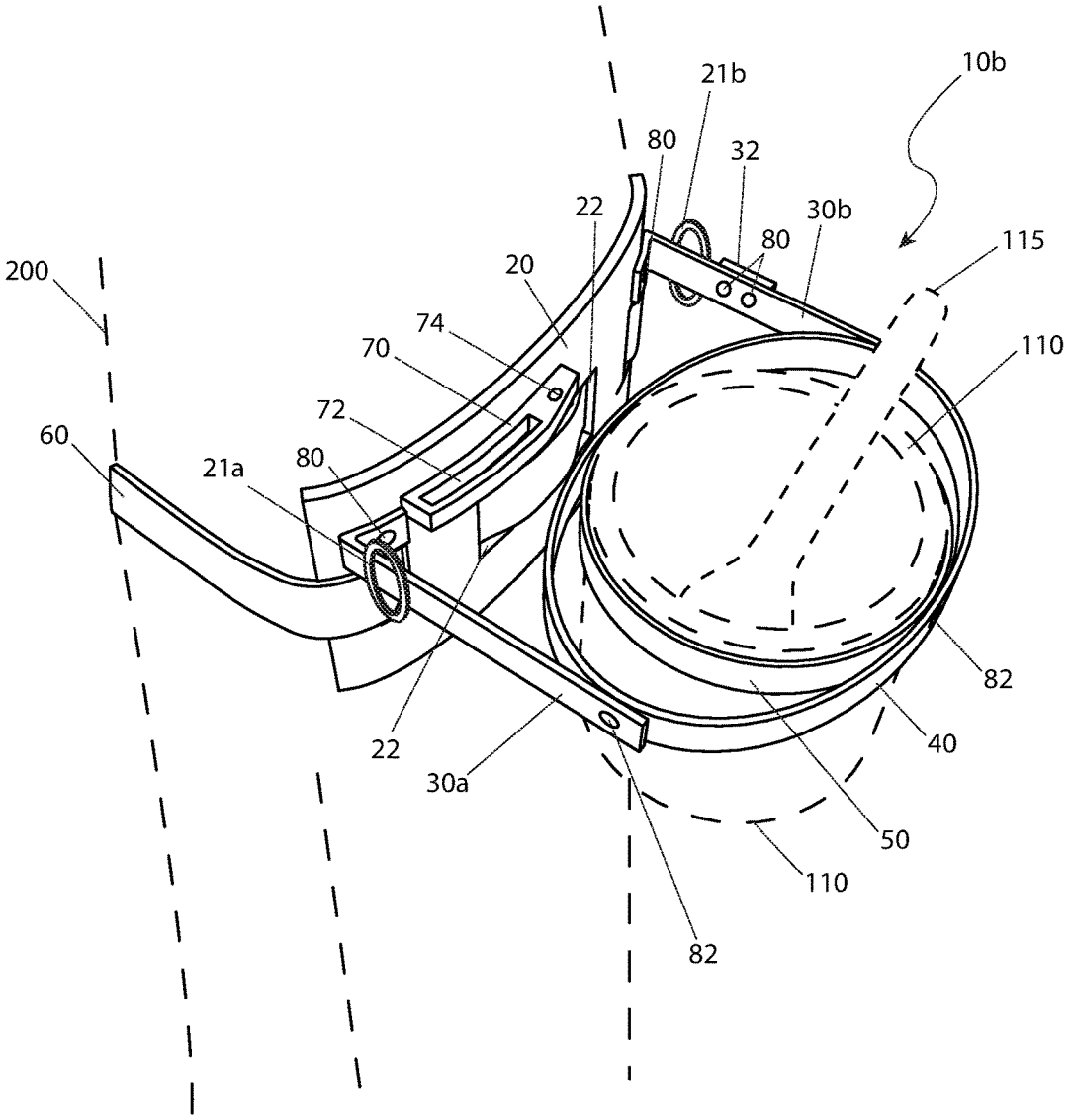

The best mode for carrying out the invention is presented in terms of its first embodiment and separate embodiment, herein depicted within FIGS. 1 through 3. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

The present invention describes a self-righting container caddy (herein described as the "apparatus") 10*a*, 10*b* which provides a means to position and support a container 110, such as a can of paint, along a user's 200 neck and/or waist area in a hands-free manner The apparatus 10*a*, 10*b* utilizes a double-axis gimbal-type holding means to provide free axial rotation of the secured container 110 to prevent spillage.

Referring now to FIG. 1, a front perspective view of the apparatus 10*a*, according to a first embodiment of the present invention, is disclosed. The apparatus 10*a*, comprises a first side support bracket 30*a*, a second side support bracket 30*b*, a middle side support bracket 30*c* spanning a length between the first side support bracket 30*a* and second side support bracket 30*b*. A first hip panel 20*a* is secured about the middle side support bracket 30*c*. The support bracket 30*c* may have an arcuate shape designed to conform to the shape of a typical user's 200 waste. It is envisioned that the apparatus 10 would be provided with container 110 holding rings 40, 50 to receive different containers 110 having different volumes such as a quart, a gallon, and the like. The side support brackets 30*a*, 30*b* are preferably metallic, having parallel and protruding appendages. The outer ring 40 is rotationally affixed between the protruding appendages utilizing rotating second fasteners 82. The outer ring 40 is in turn rotatingly affixed to the inner ring 50 at two (2) locations being rotated ninety degrees) (90° from the connection to the side support brackets 30*a*, 30*b* also using rotating second fasteners 82. A first ring 21*a* and second ring 21*b* are secured upon an interior face of the middle side support bracket 30*c* on opposite sides of the first hip panel 20*a*. Each ring 21*a*, 21*b* permit an adjustable neck strap 23 to removably secure to each ring 21*a*, 21*b* by means of a first spring hook 24*a* and second spring hook 24*b* secured to a distal end of the neck strap 23. Rings 21*a*, 21*b* may also accommodate a belt (not shown) which passes through 21*a*, next through 20*a* and then through 21*b*. With respect to this configuration, a user 200 may wear the device 10*a* about his or her neck (not shown) while supporting a container 110 in the inner ring 50.

Referring now to FIG. 2, a rear perspective view of the apparatus 10*b*, according to a separate embodiment of the present invention, is disclosed. The apparatus 10*b* comprises a hip panel 20*b*, a first side support bracket 30*a*, a second side support bracket 30*b*, an outer ring 40, an inner ring 50, a hip panel tool holder 70, and a waist strap 60. The hip panel 20*b* provides a rectangular, generally arcuate member made using materials such as an extruded plastic sheet, leather, or other semi-rigid material capable of conforming to curved hip and waist areas of the user 200. The hip panel 20*b* may also be generally planar that is capable of generally corresponding to the contour of the user 200. Just as in FIG. 1, it is envisioned that the apparatus 10*b* would be provided with container holding rings 40, 50 to receive different containers 110 having different volumes such as a quart, a gallon, and the like.

As above, the side support brackets 30*a*, 30*b* provide "L"-shaped, preferably metallic, having parallel and protruding appendages. Proximal ends of the side support brackets 30*a*, 30*b* are to be permanently affixed to opposing side edge portions of the hip panel 2*b*0 using first fasteners 80 such as rivets. The side support brackets 30*a*, 30*b* act to offset the container 110 horizontally from the user 200 having distal end portions which are affixed to the outer ring 40 via rotating second fasteners 82 such as rivets. The outer ring 40 is in turn rotatingly affixed to the inner ring 50 at two (2) locations being rotated ninety degrees) (90° from the connection to the side support brackets 30*a*, 30*b* also using rotating second fasteners 82, thereby forming a double axis gimbal-type holding means capable of maintaining the container 110 in an upright orientation. It is understood that the container 110 would be sufficiently inserted into the inner ring 50 such that a center of gravity of the container 110 and its contents would be positioned below the inner ring 50 to allow the apparatus 10 to function as described.

The hip panel tool holder 70 provides an "L"-shaped appendage being stationarily affixed to an outer surface of the hip panel 20*b* via a plurality of third fasteners 84 such as rivets. The hip panel tool holder 70 provides a top horizontal surface having features which provide a means to hold at least one (1) job-related tool. An embodiment of the hip panel tool holder 70 is illustrated here having a tool slot 72 being utilized to secure a first tool 100 such as a putty knife, and a tool aperture 74 being utilized to secure a second tool 105 such as a screw driver; however, it is understood that the hip panel tool holder 70 may be configured so as to provide various types and numbers of features designed to receive and retain various tools based upon a particular project. Additionally, the apparatus 10*b* is envisioned to include a magnetic tool holder 32 envisioned to be made using common permanent magnet materials such as iron, nickel, cobalt, and the like, and being affixed to an outer surface of the side support bracket 30*a*, 30*b* using first fasteners 80, which provides a means to conveniently position and retain tools such as a paint brush, having ferromagnetic portions.

Referring now to FIG. 3, an environmental view of the apparatus 10*b*, according to the preferred embodiment of the present invention, is disclosed. The waist strap 60 provides a means to secure the apparatus 10*b* around a user's 200 waist area. The waist strap 60 is attached to the hip panel 20 by being routed through a plurality of strap aperture portions 22 formed through the hip panel 20*b*. The waist strap 60 is envisioned to be made of textile strapping stock using natural or synthetic fibers. The waist strap 60 extends from the hip panel 20*b* in both directions. The end portions of the waist strap 60 include respective male latch 62 and female latch 66 portions to provide quick attachment and removal of the apparatus 10*b*. The latch portions 62, 66 are envisioned to provide a side-release-type latch or other quickly released mechanism further providing an integral strap length adjustment section 64 to provide adjustability based upon a waist size of the user 200. The apparatus 10*b* also comprises a first ring 21*a* secured upon the first side support and a second ring 21*b* secured upon the second side support. Rings 21*a*, 21*b* permit the device 10*b* to also be secured about the neck of a user 200 in a manner similarly described in reference to FIG. 1.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10*a*, 10*b* it would be installed as indicated in FIGS. 1 and 3.

The method of utilizing the apparatus 10*a*, 10*b* may be achieved by performing the following steps: procuring a model of the apparatus 10*a*, 10*b* having particular ring portions 40, 50 being sized so as to retain a desired size container 110 and having a hip panel tool holder 70 being configured to hold desired tools; installing the waist strap 60 onto the hip panel 20*a*, 20*b* by routing the waist strap 60 through the strap aperture portions 22, if not previously installed; adjusting a length of the waist strap 60 as desired using the length adjustment section 64; wrapping end portions of the waist strap 60 around a user's 200 waist area; securing the waist strap 60 around the user 200 by engaging the male 62 and female 66 latch portions; loading any job related tools into the hip panel tool holder 70 such as a putty knife 100 or a screw driver 105, into features such as a tool slot 72 and/or a tool aperture 74 based upon a type of project; inserting a container 110 down through the inner ring 50 until seated; utilizing the container 110 and its contents to perform a task; and, performing a task such as painting, in a hands-free manner, afforded a user 200 of the present invention 10*a*, 10*b*.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A self-righting caddy, comprising:

a frame support assembly comprising:

a first support frame having a first proximal end fastened to a first side of a middle support frame and a first distal end rotatingly affixed to an outer ring; and, a second support frame having a second proximal end fastened to a second side of said middle support frame and a second distal end rotatingly affixed to said outer ring opposite said first support frame;

a hip panel secured about said middle support frame;

an inner ring rotatingly affixed to said outer ring and adapted to hold a container;

a first strap ring secured on an interior side of said middle support frame adjacent said first side thereof;

a second strap ring secured on said interior side of said middle support frame adjacent said second side thereof; and, a neck strap having a first neck strap end removably secured to said first strap ring by a first neck strap fastener and a second neck strap end removably secured to said second strap ring by a second neck strap fastener;

wherein said caddy is adapted to be worn by a user; and, wherein said outer ring and said inner ring form a double-axis gimbaled holder for said container.

2. The caddy of claim 1, wherein said hip panel conforms to the hip and waist areas of said user.

3. The caddy of claim 1, further comprising a tool holder.

4. The caddy of claim 3, wherein said tool holder comprises a magnet.

5. The caddy of claim 4, wherein said magnet is secured to an exterior face of said first support frame.

6. The caddy of claim 1, wherein said neck strap is length adjustable.

7. The caddy of claim 1, wherein said neck strap is made of synthetic fibers.

8. The caddy of claim 1, wherein said neck strap is made of natural fibers.

9. The caddy of claim 1, wherein said first neck strap fastener and said second neck strap fastener each comprise a spring hook.

* * * * *